US006305585B1

(12) United States Patent
Saint-Ramon et al.

(10) Patent No.: US 6,305,585 B1
(45) Date of Patent: Oct. 23, 2001

(54) FILLER NOZZLE FOR PACKAGING FOR BIOLOGICAL LIQUIDS, IN PARTICULAR FOR ARTIFICIAL INSEMINATION

(75) Inventors: Jean-Gérard Saint-Ramon, Montmorency; Christian Beau, Voisins-le-Bretonneux; Alain Ehrsam, Lyon; Thierry Louviot, L'Aigle, all of (FR)

(73) Assignee: Instruments de Medecine Veterinaire, L'Aigle (FR)

( * ) Notice: Subject to any disclaimer, the term of this patent is extended or adjusted under 35 U.S.C. 154(b) by 0 days.

(21) Appl. No.: 09/580,902

(22) Filed: May 30, 2000

Related U.S. Application Data

(63) Continuation of application No. 09/014,616, filed on Jan. 28, 1998, now abandoned.

(30) Foreign Application Priority Data

Jan. 31, 1997 (FR) ..... 97 01064

(51) Int. Cl.[7] ..... B65B 1/04
(52) U.S. Cl. ..... 222/570; 222/158; 141/31
(58) Field of Search ..... 222/570, 158; 141/2, 18, 21–27, 31

(56) References Cited

U.S. PATENT DOCUMENTS

| | | | | |
|---|---|---|---|---|
| 791,480 | * | 6/1905 | Maynard . | |
| 3,343,539 | | 9/1967 | Moorhouse . | |
| 3,603,156 | * | 9/1971 | Konkol . | |
| 4,597,421 | * | 7/1986 | Wells | 141/5 |
| 4,846,785 | | 7/1989 | Cassou et al. . | |
| 5,190,880 | | 3/1993 | Cassou et al. . | |
| 5,249,610 | | 10/1993 | Cassou et al. . | |
| 5,283,170 | | 2/1994 | Cassou et al. . | |

FOREIGN PATENT DOCUMENTS

| | | |
|---|---|---|
| 0278823 | 8/1988 | (EP) . |
| 0701865 | 3/1996 | (EP) . |
| 2651793 | 3/1991 | (FR) . |

* cited by examiner

*Primary Examiner*—Steven O. Douglas
(74) *Attorney, Agent, or Firm*—Morgan & Finnegan, LLP

(57) ABSTRACT

A filler nozzle for packaging, in particular for use in artificial insemination, has a plastics material body with a male or female conical part that partly surrounds a capillary tube made from stainless steel or a plastics material. The filler nozzle is particularly suitable for filling straws with seminal liquid. It prevents pollution of the closing area of the straw. It is also compatible with automatic placement and with manual handling.

12 Claims, 3 Drawing Sheets

FILLER NOZZLE FOR PACKAGING FOR BIOLOGICAL LIQUIDS, IN PARTICULAR FOR ARTIFICIAL INSEMINATION

This is a continuation of application Ser. No. 09/014,616 filed Jan. 28, 1998 now abandoned.

BACKGROUND OF THE INVENTION

1. Field of the Invention

The present invention concerns a filler nozzle (or connector) for packaging for volumes of seminal liquid or any other biological product, such as straws, canulae, tubes and catheters, for example.

2. Description of the Prior Art

Straws are tubular reservoirs for packaging animal semen intended for artificial insemination or biological liquids, having an inside diameter which is sufficiently small for the dose to remain in place by capillary action alone, which simplifies handling in the case where the straw must be used as soon as it is filled, without intermediate storage.

Existing filler nozzles or connectors are more particularly intended for filling devices of the flask, beaker, bottle, etc type but are not suitable for filling tubes, straws, canulae or catheters, especially if it is required to leave an area free of any soiling by the filler product, for example in the case of closing by welding.

These nozzles or connectors are of the cone or needle type.

U.S. Pat. No. 5,249,610 describes discardable and re-usable nozzles used to fill straws. However, devices of this kind are not suitable for unitary filling, i.e. for filling a few straws, or for automated filling, i.e. for filling a plurality of straws without manual replacement of the nozzle.

An object of the present invention is to provide a filler nozzle that is suitable for straws.

Another object of the invention is to provide a filler nozzle preventing pollution of the closing area of the straw.

A further object of the invention is to provide a filler nozzle compatible with automatic placement, for example for use with an automatic filling device, or with manual handling (unitary filling).

SUMMARY OF THE INVENTION

The present invention provides a nozzle or connector satisfying the above objects comprising a plastics material body having a male or female conical part partly surrounding a capillary tube. The conical part of the plastics material body is adapted to grip a straw.

The capillary tube is preferably made from a material selected from the group comprising stainless steel and plastics materials.

In the case of a female conical part of the plastics material body, the nozzle advantageously has a cylindrical part aligned with the female conical part.

Again in the case of a female conical part of the plastics material body, the plastics material body includes air entry means, for example a vent or a plurality of passages.

In the case of a male conical part of the plastics material body, the male conical part advantageously comprises two cones.

The invention will be better understood on referring to the appended drawings.

DETAILED DESCRIPTION OF THE PREFERRED EMBODIMENTS

Figure 1:
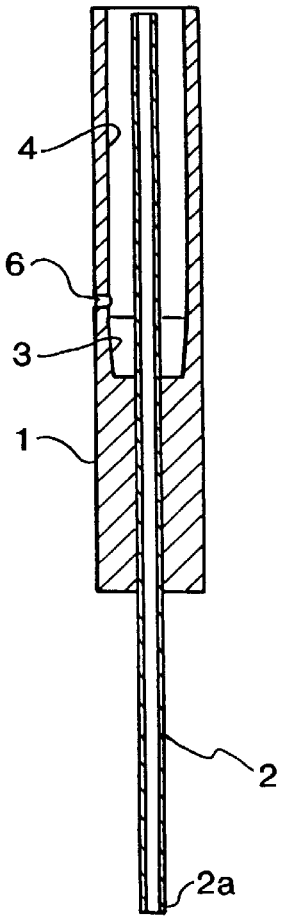
FIG. 1 is a view in section taken along its longitudinal axis of a nozzle or connector in accordance with the present invention.

The nozzle or connector of the present invention comprises a plastics material body 1 surrounding a capillary tube 2.

The capillary tube 2 is made of stainless steel or a plastics material, for example.

The nozzle has a frustoconical part 3, a cylindrical part 4 and air entry means 6.

Figure 2:
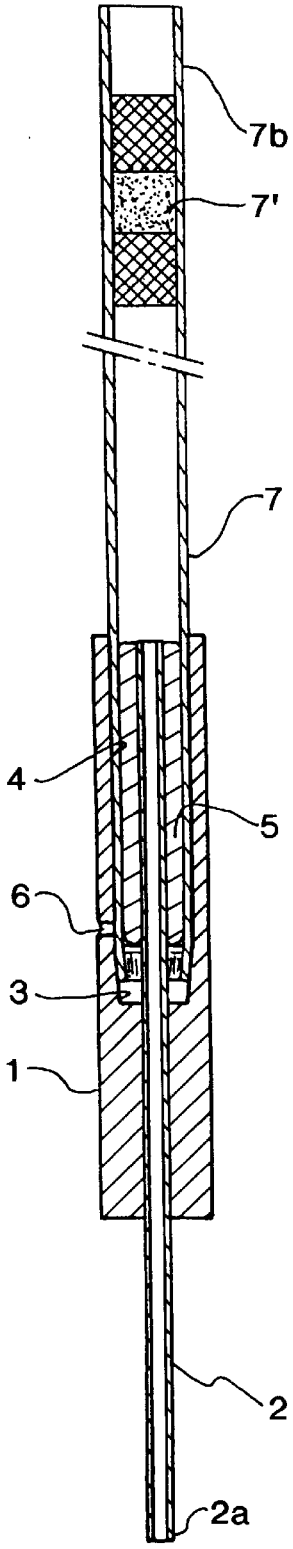
FIG. 2 is a view of the nozzle from FIG. 1 in section taken along its longitudinal axis and into which a straw has just been inserted and gripped.
Figure 4:
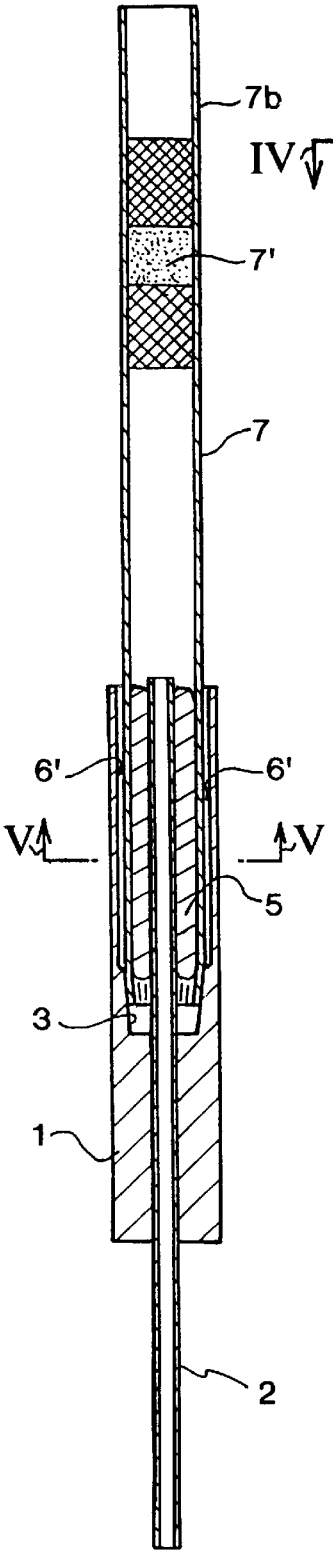
FIG. 4 is a view in section taken along its longitudinal axis of another embodiment of the nozzle of the present invention into which a straw has just been inserted and gripped.

The cylindrical part 4 guides the straw 7 (shown in FIGS. 2, 4 and 7 with its stopper 7') when fitting it and removing it, so preventing any contact with the capillary tube and the inside face of the straw to prevent any soiling by the liquid in the closing area 5.

The air entry means 6 allow air to enter on releasing the straw 7 from the cone 3 to guarantee that this area is not soiled. The air entry means 6 can be perpendicular to the longitudinal axis of the nozzle or inclined thereto.

Figure 3:
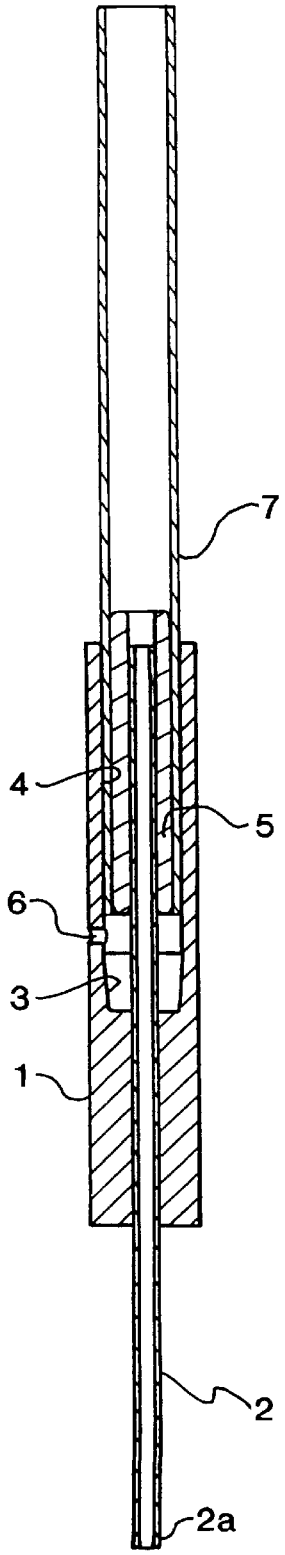
FIG. 3 is a view of the nozzle from FIG. 1 in section taken along its longitudinal axis and just after the grip on the straw has been released.
Figure 5:
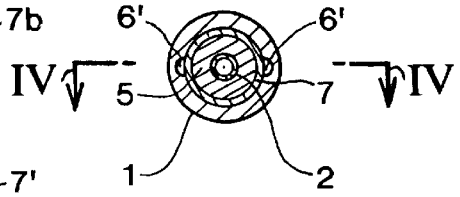
FIG. 5 is a view of the nozzle from FIG. 4 in section taken along its transverse axis.

The air entry means 6 can be a vent (FIGS. 1 through 3) or one or more passages 6'.

The plastics material body 1 can be molded onto the capillary tube 2.

The plastics material body 1 can equally be injection molded and the capillary tube 2 force fitted into it. The seal is obtained by the fit and the length of the fit or by gluing.

The plastics material body 1 can also be machined.

Figure 6:
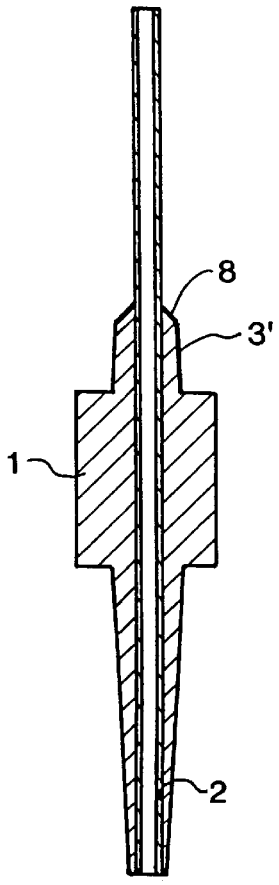
FIG. 6 is a view of a variant of the nozzle of the present invention in section taken along its longitudinal axis.
Figure 7:
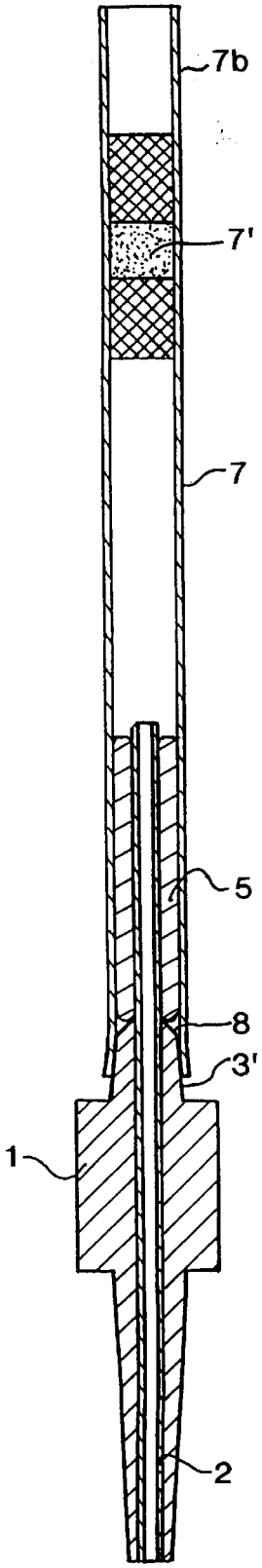
FIGS. 7 and 8 are views of another variant of the nozzle of the present invention in section taken along its longitudinal axis and into which a straw has just been inserted and gripped.
Figure 8:
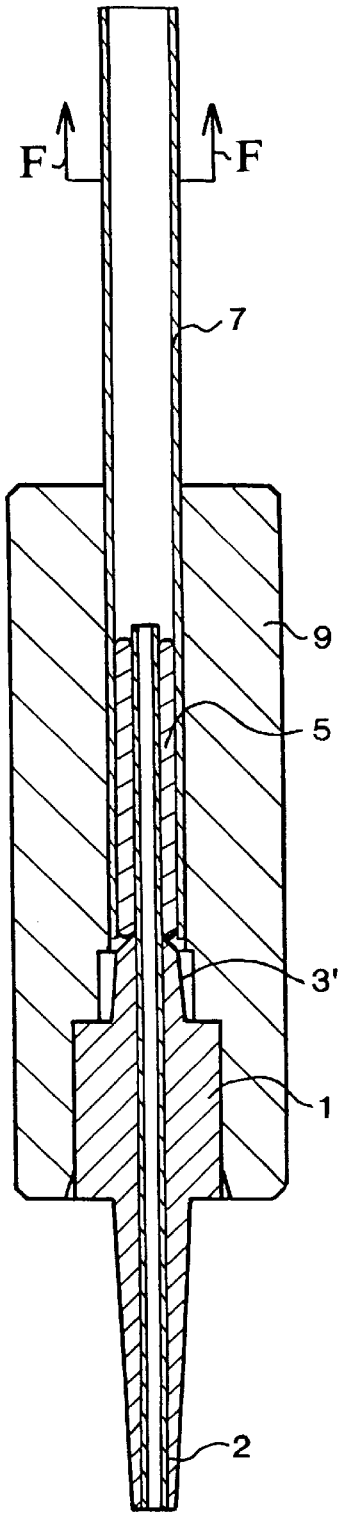

Another variant of the filler nozzle or connector of the present invention, shown in FIGS. 6 through 8, is based on a male cone 3' (rather than a female cone). There is a second cone 8 to allow air to enter on releasing the straw 7 to guarantee that the closing area 5 is not soiled. In this case it is necessary to use a guide tool 9 to release the straw 7 from the cone 3' (in the direction of the arrows F) without the capillary tube 2 coming into contact with the inside wall of the straw and soiling the closing area 5.

Figure 9:
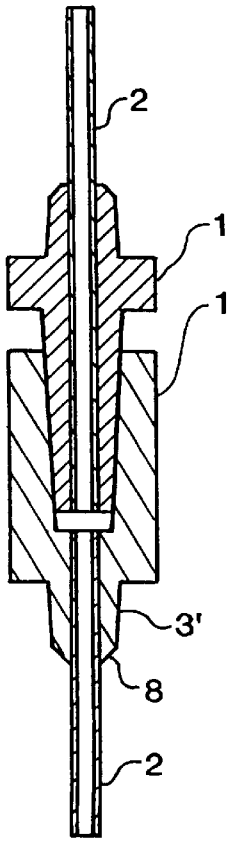
FIG. 9 is a view of another nozzle of the invention in section taken along its longitudinal axis.
Figure 10:
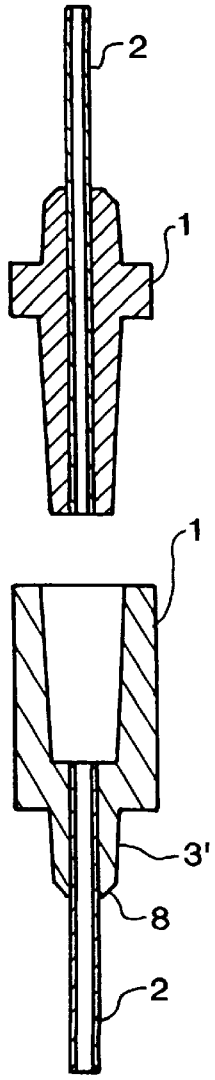
FIG. 10 is an exploded view of the nozzle from FIG. 9 in section taken along its longitudinal axis.

Another variant of the filler nozzle or connector of the present invention shown in FIG. 9, is made in two parts.

A straw is filled and closed in a manner known in itself, the end 2*a* of the capillary tube 2 being immersed in the biological product with which the straw is to be filled and the end 7*b* of the straw 7 being connected to suction means. The straw is closed in a manner known in itself. In this connection the skilled person may refer to U.S. Pat. No. 5,249,610 mentioned above.

The skilled person will readily understand that the invention has been described and illustrated by means of particular embodiments but that many variants are feasible within the scope of the invention as defined by the appended claims.

There is claimed:

1. A filler nozzle for biological liquid packaging comprising a plastics material body having a conical part partly surrounding a capillary tube, wherein said conical part is a female conical part;

said plastic material body has a first cylindrical cavity that surrounds and holds part of a capillary tube therewithin;

said capillary tube and said first cylindrical cavity are coaxially aligned; and said plastics material body includes an air entry means.

2. The filler nozzle claimed in claim 1 wherein said capillary tube is made from a material selected from the group comprising stainless steel and plastics materials.

3. A filter nozzle as claimed in claim 1 further comprising a cylindrical part aligned with said female conical part.

4.The filter nozzle claimed in claim 1 wherein said air entry means consists of a vent.

5. The filter nozzle claimed in claim 1 wherein said air entry means consists of a passage or a plurality of passages.

6. The filler nozzle claimed in claim 1 wherein said conical part is a male conical part.

7. The filler nozzle claimed in claim 6 wherein said conical part comprises two cones.

8. A filler nozzle as claimed in claim 6 made in two parts.

9. The filter nozzle claimed in claim 1 wherein the plastic material body also has a frustoconical cavity therewithin, one portion of which having an end that is adjacent to an end of the first cylindrical cavity, the other portion of the frustoconical cavity defining a second cylindrical cavity that is coaxially aligned with the first cylindrical cavity and has a larger cross-sectional area than the first cylindrical cavity.

10. The filter nozzle claimed in claim 9 wherein the second cylindrical cavity is adapted to receive a cylindrical straw therewithin in coaxial alignment therewith.

11. The filter nozzle claimed in claim 1 wherein the air entry means are located within sidewalls of the plastic material body.

12. The filter nozzle claimed in claim 1 wherein said first cylindrical cavity is adapted to guide a cylindrical straw when said straw is fitted into and removed from said first cylindrical cavity, so as to prevent any contact by said straw with said capillary tube and an inside wall of said straw.

* * * * *